United States Patent [19]

Bozung

[11] 4,183,719

[45] Jan. 15, 1980

[54] COMPOSITE IMPELLER WHEEL WITH IMPROVED CENTERING OF ONE COMPONENT ON THE OTHER

[75] Inventor: Hanns-Günther Bozung, Neusass-Westheim, Fed. Rep. of Germany

[73] Assignee: Maschinenfabrik Augsburg-Nürnberg Aktiengesellschaft (MAN), Augsburg, Fed. Rep. of Germany

[21] Appl. No.: 792,508

[22] Filed: May 2, 1977

[30] Foreign Application Priority Data

May 13, 1976 [DE] Fed. Rep. of Germany ..... 2621201

[51] Int. Cl.[2] ..... F01D 5/04; F01D 5/06

[52] U.S. Cl. ..... 416/183; 415/143; 416/244 A

[58] Field of Search ..... 416/183, 244 A; 415/143

[56] References Cited

U.S. PATENT DOCUMENTS

| | | | |
|---|---|---|---|
| Re. 27,038 | 1/1971 | Newland | 416/183 X |
| 2,469,125 | 5/1949 | Meisser | 416/244 A X |
| 2,482,462 | 9/1949 | Browne | 416/186 |
| 2,577,134 | 12/1951 | Land | 416/244 A X |
| 3,642,383 | 2/1972 | Andrig | 416/183 |
| 3,671,140 | 6/1972 | Shank | 416/183 |
| 3,893,817 | 7/1975 | Hackbarth et al. | 416/183 X |
| 3,958,905 | 5/1976 | Wood | 416/183 |
| 4,039,268 | 8/1977 | Cotton | 416/183 |
| 4,053,261 | 10/1977 | Pennig | 416/244 A |

FOREIGN PATENT DOCUMENTS

| | | | |
|---|---|---|---|
| 577325 | 6/1959 | Canada | 415/143 |
| 755198 | 11/1952 | Fed. Rep. of Germany | 416/183 |
| 1275720 | 8/1968 | Fed. Rep. of Germany | 416/183 |
| 1428185 | 11/1968 | Fed. Rep. of Germany | 416/183 |
| 2037785 | 11/1971 | Fed. Rep. of Germany | 415/143 |
| 2621201 | 11/1977 | Fed. Rep. of Germany | 416/183 |
| 1022176 | 3/1953 | France | 416/183 |
| 47-30048 | 5/1972 | Japan | 416/183 |
| 340450 | 1/1931 | United Kingdom | 416/214 A |
| 668093 | 3/1952 | United Kingdom | 416/183 |
| 761187 | 11/1956 | United Kingdom | 416/183 |
| 791240 | 2/1958 | United Kingdom | 415/143 |
| 179414 | 4/1966 | U.S.S.R. | 416/183 |

*Primary Examiner*—Everette A. Powell, Jr.

*Attorney, Agent, or Firm*—Frishauf, Holtz, Goodman & Woodward

[57] ABSTRACT

The rear radially extending component of a radial flow turbine or compressor rotor is centered on a cylindrical surface spaced from the common shaft, on which the rotor is wedged by a tapered sleeve, by an extension of one component fitting into a recess in the other, but this cylindrical surface is not required to transfer any torque, because that is transferred from the forwardly extending component to the radially extending component by ridges of one fitting into radial grooves of the other near the base of the vanes. Greater thermal expansion of the radially extending component is accommodated by the claw ridge slipping radially in its groove. When the centering surface is provided on a rearward extension of the forwardly extending component instead of on a forward extension of the radially extending component, then an annular recess is provided to form a lip engaging the extension, so that the lip will not be affected by centrifugal forces resulting from the larger external diameter of the radially extending component.

2 Claims, 2 Drawing Figures

COMPOSITE IMPELLER WHEEL WITH IMPROVED CENTERING OF ONE COMPONENT ON THE OTHER

Figure 1:
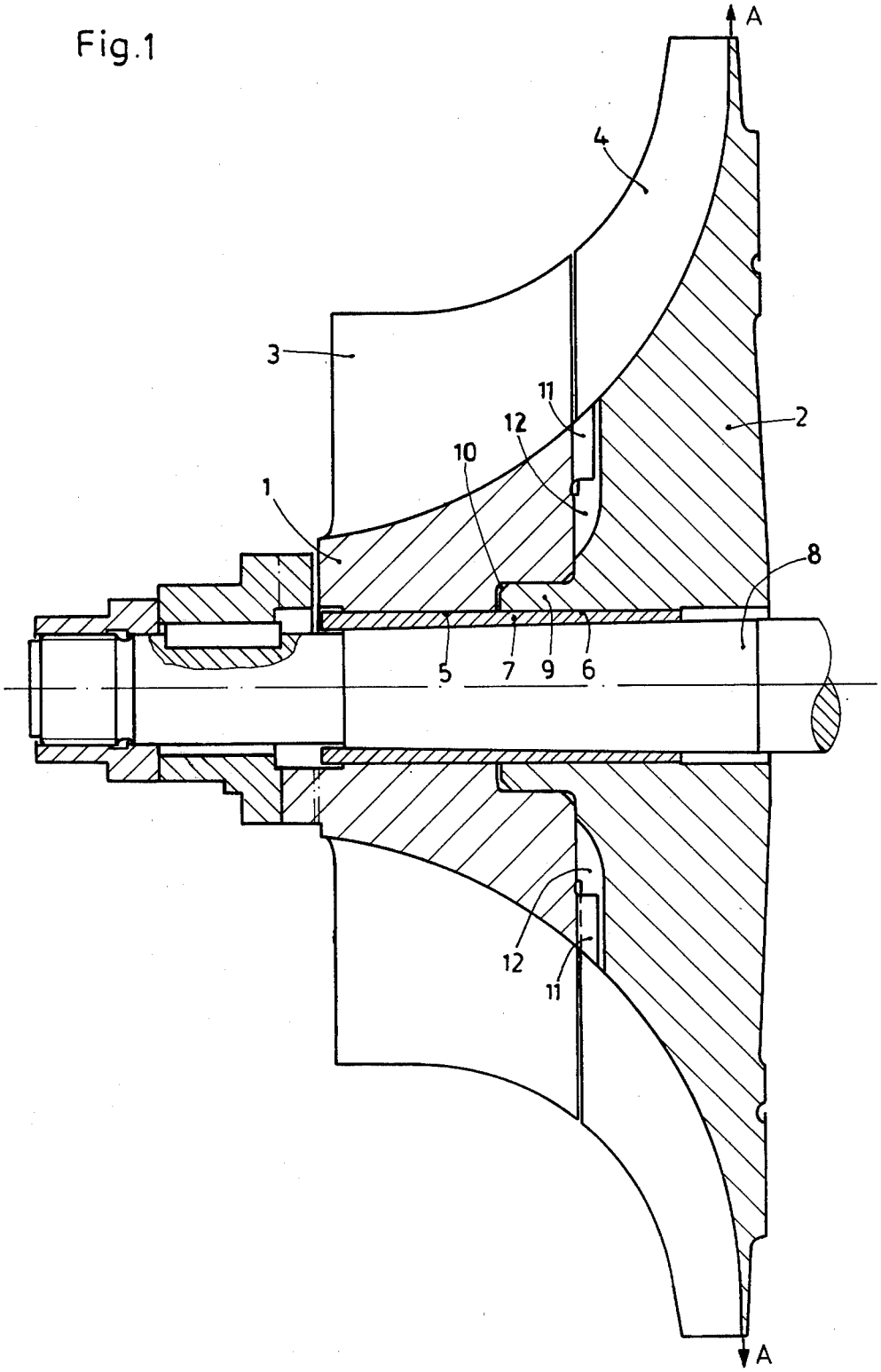

The present invention relates to an impeller wheel for a flow machine composed of a forwardly extending portion and a radially extending portion immediately behind it on a common shaft. The vanes on the forwardly extending portion of the impeller wheel operate with substantially axial flow of the flow medium between the vanes, while the vanes of the radially extending portion to the rear operate with substantially radial flow of the flow medium. The flow medium is typically, but not necessarily, a gas and the flow machine may be in that case either a turbine or a compressor.

Composite impellers have the advantage that different materials can be used for the two components, in each case suited to withstand the kinds of stresses to which the particular component is subject. As shown in Swiss Pat. No. 429,007, in known types of impellers of the class just described, the forwardly extending component and the radially extending component were each independently centered on the common shaft. In this case, a joint is provided between the two parts in which a vibration damping material, coupling the two components together elastically, is inserted. In operation, large centrifugal forces are exerted on the radially extending component that are directed on its rearward portion which faces away from the forwardly extending component. These forces tend to loosen the radially extending component from the shaft. This effect produces the danger of a relative twisting away from each other of the two components, moving their respective vanes out of registry with each other and spoiling the smooth flow surfaces for the flow medium which the vanes should together provide. Furthermore, the torque between the radially extending component and the shaft must at least partly be transmitted through the elastic material in the joint. The latter is thereby exposed to substantial stresses which shorten the installation life of the impeller wheel. Furthermore, in addition to the centrifugal forces, the radially extending component is also subjected to a higher temperature loading than the forwardly extending component. In the case of a turbine impeller, the hot gases enter by way of the radially extending component and in the case of a compressor impeller, the temperature of the air or other gas being increasingly compressed as it flows through rises towards the exit of the machine, so that in both cases the radial-flow portion of the machine is more greatly heated.

It was also disclosed in the above-described Swiss patent, that the forwardly extending component could be centered and mounted on an annular extension of the radially extending component. In the arrangement thus disclosed, however, large centrifugal forces arose in the radially extending portion that tended to loosen the radially extending portion from the shaft, so that the torque had to be transmitted between impeller and shaft largely through the annular extension in question and, in the transition region between the radially extending component and the annular extension of the forwardly extending component, substantial stresses arose.

It is an object of the present invention to provide an easily produceable two-component impeller that will withstand high speeds of rotation and high thermal loading with a firm and reliable centering of the radially extending component in spite of its high thermal expansion and centrifugal stressing.

SUMMARY OF THE INVENTION

Briefly, the radially extending component is centered on the forwardly extending component a forward extension fitting into a recess in the rear of the forwardly extending component which is there shrink-fitted onto the forward extension of the radially extending component and, in the portion of facing and surfaces of the components adjacent to the base of the vanes, there are provided on one component at least two radially running grooves and on the other component at least two claw ridges each of which grips into one of the grooves, the grooves being longer than the ridges to allow for relative movement under stress.

By the disposition of the features providing for centering and their separation from those provided for transferring torque, it is made sure that in spite of different degrees of expansion of the two components in operation, the registry of the vanes of the two components is reliably maintained and a high torque can be transmitted without danger of damage to or distortion of the components. Two such grooves are sufficient, but it may be convenient to use three or more.

Figure 2:
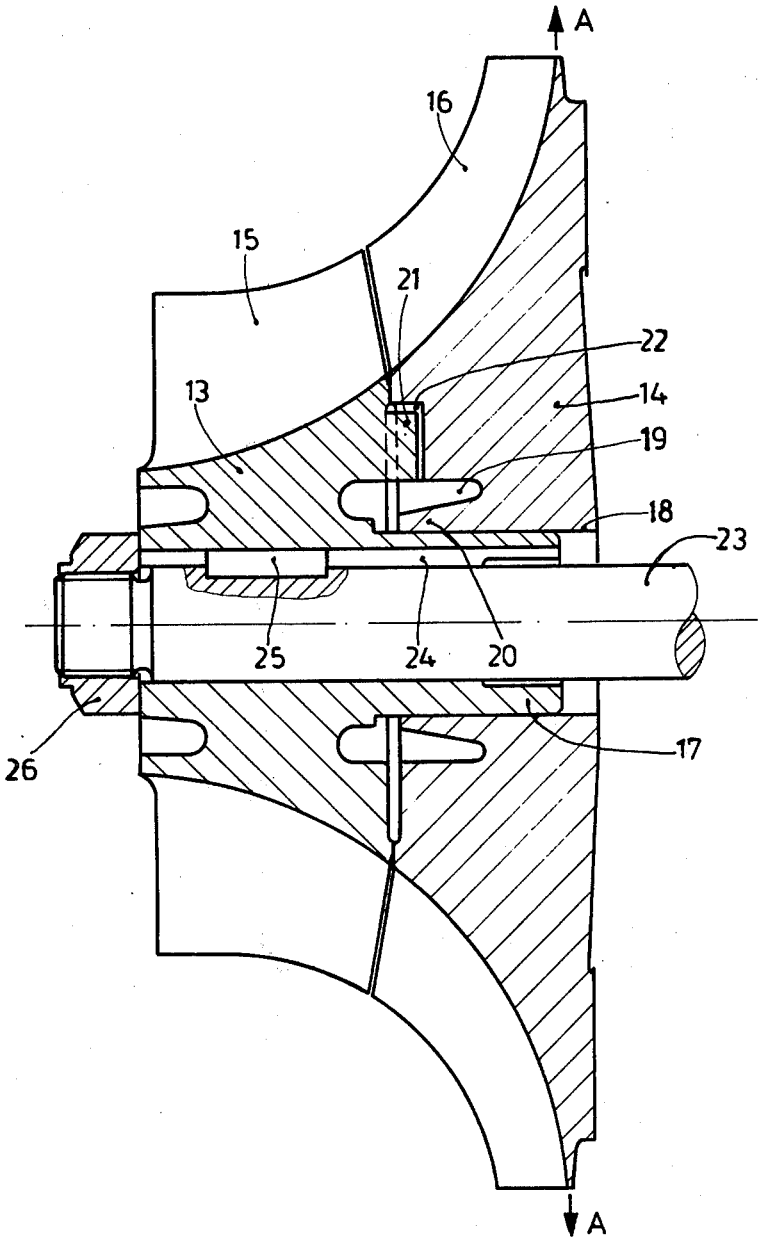

The invention is further described by way of illustrative examples with reference to the annexed drawing, in which:

FIG. 1 is a longitudinal cross-section through the axis of the shaft and impeller of an embodiment of the invention, and FIG. 2 is a similar longitudinal section of another kind of composition impeller.

FIG. 1 illustrates an impeller for a compressor that consists of a forwardly extending component 1 made of an aluminum casting alloy and a radially extending portion 2 made of an aluminum forging alloy. The forwardly extending component 1 is made integrally with vanes 3 and the radially extending component is made integrally with vanes shown at 4. The two components 1 and 2 have central bores 5 and 6 of the same diameter and they are mounted on a tapered shaft 8 by means of a inserted from the free end of the forwardly extending component 1.

The radially extending component 2 has an annular forward extension 9, of which the inner surface forms a portion of the central bore 6 of the component. The outer surface of the annular forward extension 9 bears against the cylindrical boundary surface of an annular cavity or recess 10 in the forwardly extending component 1 for centering purposes. It is particularly effective to shrink the forwardly extending component 1 on the radially extending component 2 with the annular recess 10 of the former on the annular extension 9 of the latter.

Immediately adjacent to the vanes 3 and 4 there are provided in the contact surface between the two components 1 and 2, two claw ridges 11 on the forwardly extending component 1 which project in a radial direction. Of course, it is also possible to provide more than two claws or studs instead of merely two. Each claw 11 fits into a corresponding recess in the facing surface of the radially extending component and since the claws are in this case in the shape of ridges running radially, the grooves 12 likewise run radially. The radial length of the grooves 12 is greater than that of the claws 11.

In operation, a substantially stronger centrifugal force is exerted on the radially extending component 2 than on the forwardly extending component 1, because the diameter of the former is greater. The maximum centrifugal force arises in the plane designated by the arrows A and it produces circumferential tensions that increase radially inward, and have their maximum at the edge of the bore on the end of the impeller which is away from the vanes. These tensions produce an expansion of the radially extending portion 2 that increases in the axial direction and tends to separate the component from the shaft. Since the extension 9 is disposed in the region of the forwardly extending component and has only a slight diameter, there are no substantial centrifugal forces there and hence no substantial circumferential tension. There are of course certain stresses at the transition between the extension 9 and the main body of the radially extending portion 2, but these are of no consequence, because the extension 9 has only the centering function and does not need to transfer any torque. The torque is transferred by the claws 11 and the grooves 12. Stressing of this connection by centrifugal forces that may arise is excluded, because the claws 11 can move radially within the respective grooves 12 and the circumferential stresses in this region are already small. The claws 11 and the grooves 12, not only transfer torque, but reliably assure the registry of all the vanes, as for example the vane 3 and the vane 4, so that the surfaces of the vane 3 are flush with those of the vane 4, and so on, and no relative shifts of these vanes in the circumferential direction can take place that would lead to exposed edges that would impair the desired undisturbed streaming of the flow medium through the vanes.

A further advantage is provided in that the individual components can be simply and accurately fashioned. The grooves in the radially extending portion can be milled in a single machine tool set-up. The projecting claws can be very accurately produced by machining the adjacent annular surface in a single machining set-up. All other machining is rotary machining which likewise can be very accurately carried out in a single set-up.

The impeller illustrated in FIG. 1 has the further advantage that it can be firmly fastened together before being firmly mounted on the shaft by means of the tapered sleeve.

The impeller illustrated in FIG. 2 is also composed of a forwardly extending component 13 and a radially extending component 14, each carrying vanes 15 and 16, respectively. The forwardly extending component 13 has an annular extension 17 on the outer surface of which the radially extending component 14 is mounted by its inner bore 18. An annular undercutting 19 is provided in the disk-like contact surface of the radially extending portion 14 which forms a lip 20 that bears against the outer surface of the annular rearward extension 17 of the forwardly extending component 13.

Claws 21 are again provided on the side of the forwardly extending component 13 facing the radially extending component 14. These claws 21 grip into the grooves 22. In the illustrated example, three claws are provided, of which only one is visible in the drawing. It is also possible to provide the grooves in the forwardly extending component 13 and the claws in the radially extending component 14.

For fixing the impeller composed of the components 13 and 14 on a shaft 23 in this case, an axial groove 24 is provided in the forwardly extending component 13, into which a spline 25 engages. A nut 26 is used to press the impeller against a stop collar, not shown in the drawing, on the rear side of the impeller in order to secure the impeller axially on the shaft 23.

If now the radially extending component 14 expands under the effect of centrifugal force, which again have their maximum value in the plane designated by the arrows A, the outer region of the radially extending component seeks to lift off or loosen from the annular extension 17 of the forwardly extending component. As the result of the undercutting 19, however, no appreciable centrifugal force has effect in the region of the lip 20, so that the centering of the radially extending component 14 with respect to the forwardly extending component 13 is maintained by the lip 20. The securing of the two components against relative rotation, as well as the transfer of torque between them, is produced by the claws 21 and the grooves 22 just as in the first illustrative embodiment shown in FIG. 1, but there is the disadvantage that the undercutting 19 must be provided as stated above and the important advantages of shrink-fitting the less stressed forward component onto the more stressed radially extending component for centering the latter are unavailable.

Although the invention has been described with reference to a particular illustrative embodiment, variations and modifications are of course possible within the inventive concept.

I claim:

1. A composite impeller of a flow machine composed of a forwardly extending component and a radially extending component axially aligned with each other in close proximity and each having vanes which register edgewise with the vanes of the other, the vanes of the forwardly extending component being shaped to operate with axial flow of a flow medium and the vanes of the radially extending component being shaped to operate with radial flow of said flow medium, said impeller incorporating also the combination of features consisting in that:

both said forwardly extending component and said radially extending component have axial bores and are mounted on a common shaft that passes completely through both of them, said shaft having a tapered surface facing the narrowest portion of the bores of said components, with the diameter decreasing forwardly;

said radially extending component (2) has an annular forward extension (9) concentric with said shaft (8) and said forwardly extending component (1) is firmly mounted and centered on said shaft and has a recess (10) into which said forward extension (9) of said radially extended component fits for centering said radially extending component on said forwardly extending component (1);

said forwardly extending component (1) is shrink-fitted onto said forward extension (9) of said radially extending component (2);

a sleeve (7) is interposed between the tapered portion of said shaft and said bores of said components and wedged firmly therebetween for centering said forwardly extending component and transmitting driving force between said shaft and at least said forwardly extending component, and in the region adjacent to the base of the vanes (3,4) the substantially transverse end surface of one component facing the other component has at least two radially running grooves and the facing end surface of the other component has at least two gripping claw ridges (11) each extending into one of said grooves, said grooves being longer than said ridges to allow relative radial movement.

2. A composite impeller as defined in claim 1 in which said grooves (12) are in the forward end surface of said radially extending component (2) radially farther out than the forward extension (9) thereof and said ridges (11) are provided on the rear end surface of said forwardly extending component (1) radially beyond said recess (10).

* * * * *